US008689719B1

(12) United States Patent
Roberts

(10) Patent No.: US 8,689,719 B1
(45) Date of Patent: Apr. 8, 2014

(54) BOAT BABY—RETRACTABLE MARINE LINE

(71) Applicant: Frank Crawford Roberts, Sandy, UT (US)

(72) Inventor: Frank Crawford Roberts, Sandy, UT (US)

(73) Assignee: Frank C. Roberts, Sandy, UT (US)

( * ) Notice: Subject to any disclaimer, the term of this patent is extended or adjusted under 35 U.S.C. 154(b) by 0 days.

(21) Appl. No.: 13/756,511

(22) Filed: Jan. 31, 2013

(51) Int. Cl.
*B63B 21/00* (2006.01)

(52) U.S. Cl.
USPC ..... 114/230.23

(58) Field of Classification Search
USPC ..... 114/254, 364, 230.23
See application file for complete search history.

(56) References Cited

U.S. PATENT DOCUMENTS

| | | | | |
|---|---|---|---|---|
| 2,998,796 | A * | 9/1961 | Wittrock | 114/254 |
| 3,813,055 | A * | 5/1974 | Pickrell | 242/396.9 |
| 4,930,719 | A * | 6/1990 | Sehl | 242/394 |
| 7,377,227 | B2 * | 5/2008 | LaRoche | 114/361 |
| 7,458,334 | B2 * | 12/2008 | Baker | 114/362 |
| 8,220,405 | B2 * | 7/2012 | Christensen et al. | 114/254 |

* cited by examiner

*Primary Examiner* — Stephen Avila
(74) *Attorney, Agent, or Firm* — Frank C. Roberts

(57) ABSTRACT

BOATBABY, a portable, auto retractable marine line (rope) reel, attachable, spring loaded receptacle for marine line (rope) used in docking, trailering and launching a boat is disclosed. No current device exits.

1 Claim, 1 Drawing Sheet

BOAT BABY—RETRACTABLE MARINE LINE

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

Broadly, an embodiment of the present invention generally provides a retractable marine rope and may be referred to as a "BOATBABY" retractable marine rope. Embodiments of the present invention may be portable and may be attachable to a boat or pleasure craft. Embodiments of the present invention may be useful during boat launching and docking.

Figure 1:
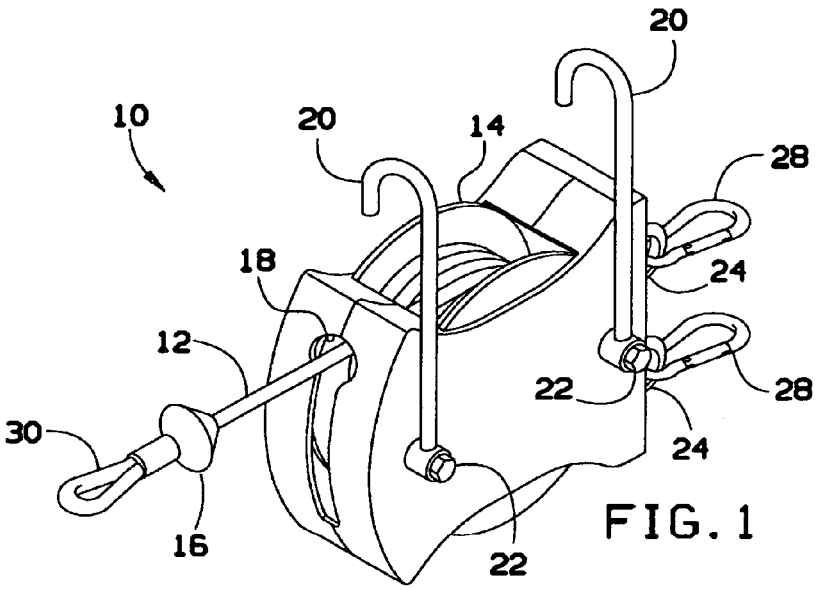
FIG. 1 is a perspective view of a retractable marine rope assembly according to one embodiment of the present invention.
Figure 2:
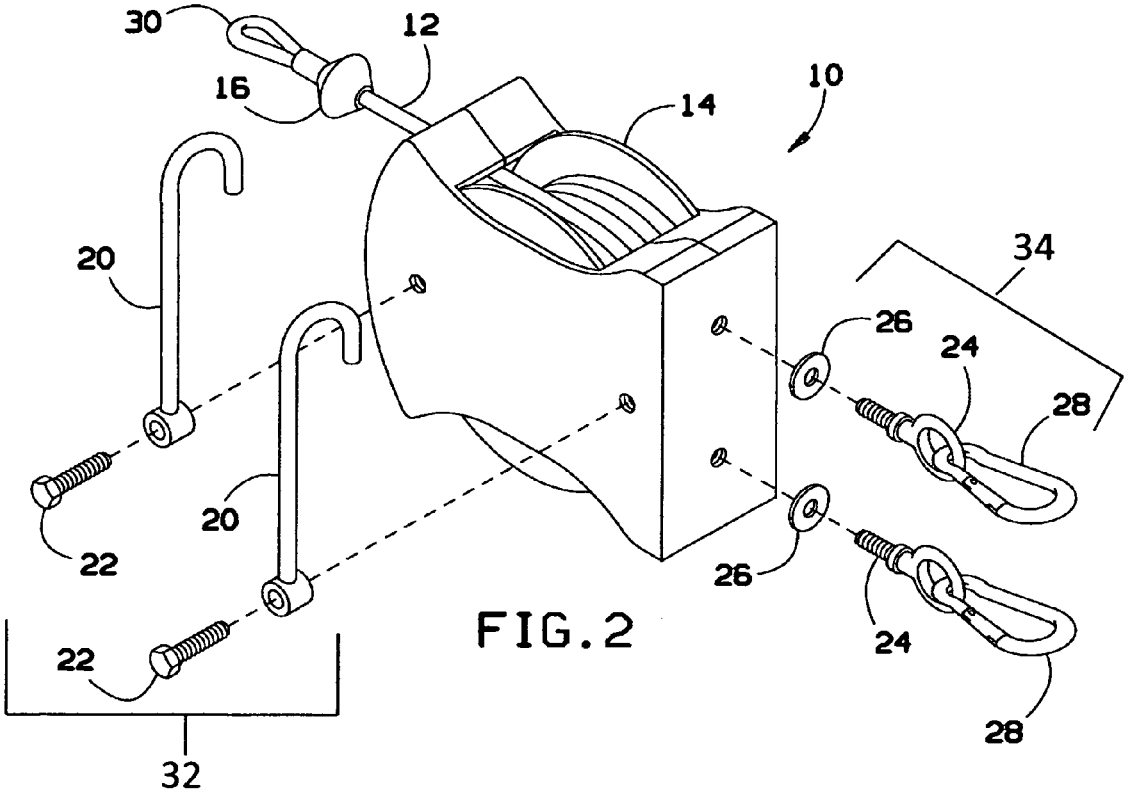
FIG. 2 is an exploded view of the retractable marine rope assembly of FIG. 1.

A retractable marine rope assembly 10 according to an embodiment of the present invention is shown in FIGS. 1-2. The retractable marine rope assembly 10 may include a retractable spring loaded reel 14, a rail coupling sub-assembling 32 and an attaching sub-assembly 34.

The retractable spring loaded reel 14 may include a length of marine rope 12. For some embodiments, the marine rope 12 may be about 50 feet in length and may include a loop 30. The retractable spring loaded reel 14 may include a marine rope guide 18 and the marine rope 12 may be provided with a marine rope stop 16.

The rail coupling sub-assembly 32 may be in contact with the retractable spring loaded reel 14 and may be designed to couple the reel 14 to a top rail (not shown) of a boat (not shown). For some embodiments, the rail coupling sub-assembly 32 may comprise at least one top rail hook 20 and at least one bolt 22. For some embodiments, the rail coupling sub-assembly 32 may include two top rail hooks 20 and two bolts 22 and may be configured to suspend the retractable spring loaded reel 14 from the top rail of the boat.

The attaching sub-assembly 34 may be in contact with the retractable spring loaded reel 14 and may be designed to attach the reel 14 to a stanchion (not shown) of the boat. For some embodiments, the attaching sub-assembly 34 may comprise at least one carabiner fastener 28, at least one eyebolt 24 and at least one washer 26. For some embodiments, the attaching sub-assembly 34 may include two carabiner fasteners 28, two eyebolts 24 and two washers 26. For some embodiments, the attaching sub-assembly 34 may be configured to releasably attach the retractable spring loaded reel 14 to the stanchion of the boat.

To install, a person may use the rail coupling sub-assembly 32 to suspend the retractable spring loaded reel 14 from the rail of the boat and may use the attaching sub-assembly 34 to fasten the retractable spring loaded reel 14 to the stanchion of the boat.

To use, the person may pull the desired length of marine rope 12 from the retractable spring loaded reel 14, exit the boat and secure the rope 12 to a dock cleat (not shown).

Using embodiments of the present invention, one person may control both the bow and stern of the boat. Embodiments of the present invention may reduce collisions and drifting while deboarding. Embodiments of the present invention may provide rope storage and eliminate the time spent searching for the rope.

It should be understood, of course, that the foregoing relates to exemplary embodiments of the invention and that modifications may be made without departing from the spirit and scope of the invention as set forth in the following claims.

What is claimed is:

1. A boat mooring reel comprising;

a reel having a length of marine rope and a spring able to retract the marine rope;

a reel housing having a top, a bottom, lateral sides, a rear side and a front side rope slot, the reel housing formed so that the reel extends through the top and bottom of the housing;

a rail coupling sub assembly in the form of a pair of hooks that are horizontally spaced and being coupled to the same lateral side of the reel housing to attach the reel to a boat top rail; and, an attaching sub assembly in the form of a pair of carabiners that are vertically spaced and coupled to the rear side of the housing opposite of the rope slot, to attach the reel to a boat stanchion.

* * * * *